US007736193B2

(12) United States Patent
Edeler et al.

(10) Patent No.: US 7,736,193 B2
(45) Date of Patent: Jun. 15, 2010

(54) AUDIO AND VIDEO PLUG AND SOCKET HAVING INTEGRATED VIDEO CONTACT

(76) Inventors: Wolfgang Edeler, Adelheidstrasse 34, 48691 Vreden (DE); Markus Thrien, Bergmannstrasse 35, 45968 Gladbeck (DE)

( * ) Notice: Subject to any disclaimer, the term of this patent is extended or adjusted under 35 U.S.C. 154(b) by 269 days.

(21) Appl. No.: 11/662,394

(22) PCT Filed: Sep. 10, 2004

(86) PCT No.: PCT/IB2004/002933

§ 371 (c)(1), (2), (4) Date: Dec. 3, 2007

(87) PCT Pub. No.: WO2006/027640

PCT Pub. Date: Mar. 16, 2006

(65) Prior Publication Data

US 2008/0188122 A1 Aug. 7, 2008

(51) Int. Cl.
*H01R 33/20* (2006.01)

(52) U.S. Cl. ..... 439/675; 439/63; 439/188; 439/581

(58) Field of Classification Search ..... 439/63, 439/188, 578, 581, 650, 675, 677, 678
See application file for complete search history.

(56) References Cited

U.S. PATENT DOCUMENTS 2,461,268 A * 2/1949 Goldfield ..... 439/675
2,702,376 A * 2/1955 Brush ..... 439/252
4,593,464 A * 6/1986 Williams et al. ..... 29/879
5,409,403 A * 4/1995 Falossi et al. ..... 439/668
5,984,687 A * 11/1999 Schwarz ..... 439/17
6,069,960 A 5/2000 Mizukami et al.
6,729,911 B1 * 5/2004 Hu ..... 439/675
6,907,615 B1 * 6/2005 Alexander et al. ..... 725/80
7,311,566 B2 * 12/2007 Dent ..... 439/843

(Continued)

FOREIGN PATENT DOCUMENTS

EP 1 309 044 A1 5/2003

(Continued)

OTHER PUBLICATIONS

Patent Abstracts of Japan—Japanese Publication No. 11066829 A, Mar. 9, 1999.

(Continued)

*Primary Examiner*—James Harvey

(57) ABSTRACT

An audio and video plug is provided, comprising a male audio plug having at least one audio signal plug contact and one audio ground plug contact, the plug being characterized by a substantially cylindrical video ground plug contact located radially outward said male audio plug, and being electrically insulated from said male audio plug, and at least one video signal plug contact being located inward of said video ground plug contact, and being electrically insulated from said video ground plug contact. Further an audio and video socket is provided, comprising a female audio socket having at least one audio signal socket contact and one audio ground socket contact, and a video signal socket contact being electrically insulated from said female audio socket, the socket being characterized by at least one video ground socket contact located radially outward said female audio socket, and being electrically insulated from said female audio socket and said video signal socket contact.

23 Claims, 8 Drawing Sheets

U.S. PATENT DOCUMENTS

| | | | | |
|---|---|---|---|---|
| 7,407,416 | B1 * | 8/2008 | Rogers et al. | 439/669 |
| 7,585,178 | B1 * | 9/2009 | Abrahamsson et al. | 439/309 |
| 2004/0038593 | A1 | 2/2004 | Siddiqui | |
| 2008/0188122 | A1 * | 8/2008 | Edeler et al. | 439/540.1 |
| 2009/0170375 | A1 * | 7/2009 | Dayan et al. | 439/650 |

FOREIGN PATENT DOCUMENTS

| | | |
|---|---|---|
| EP | 1 453 153 A2 | 9/2004 |
| WO | WO 2004/055948 | 7/2004 |

OTHER PUBLICATIONS

International Search Report of International Application No. PCT/IB2004/002933—Date of Completion of Search—Apr. 21, 2005.

Written Opinion for PCT/IB2004/002933 mailed on Jan. 22, 2005.

* cited by examiner

AUDIO AND VIDEO PLUG AND SOCKET HAVING INTEGRATED VIDEO CONTACT

CROSS REFERENCE TO RELATED APPLICATIONS

This application is a national phase application based on International Application No. PCT/IB2004/002933 that was filed Sep. 10, 2004, the disclosure of which is incorporated herein in its entirety.

TECHNICAL FIELD

The present invention relates to a plug and socket having audio and video contacts, and particularly to a plug and a socket being suitable for portable electronic devices and compatible to a standard audio plug or socket, respectively.

BACKGROUND

Portable devices like mp3 players, game decks, laptops, notebooks, PDAs, cellular phones and the like usually comprise at least one output socket for connecting a headset. Digital cameras sometimes comprise a TV-out socket for putting out a video signal for display on a TV set. Future portable devices, particularly game decks like the Nokia® N-Gage, will be able to put out both audio and video signals. These game decks can then be used like non-portable video game consoles when being connected to a standard TV set and outputting the game graphics therewith. As the processing power of such portable devices, PDAs, smartphones and the like also more and more enables video playback functions it is desirable to output the video signal on a bigger screen than the internal one, to watch videos on a suitably big display.

Presently available are various plug types for audio or video signals, like the common 3.5 mm stereo plug, cinch type plugs, S-VHS plugs and many others. As the mere size of the plugs and particularly of their corresponding sockets in the electronic device has a great, if not decisive impact on the size of the electronic device, it is desirable to provide plug/socket connection systems being as small as possible. Also the number of plugs/sockets should correspondingly be kept as low as possible. The available size of a device will in the first place be used to place control elements, displays and the like. It is therefore undesirable to be forced to sacrifice a large part of the outer surface of a device to provide big and numerous connection sockets. Also it is desirable to have only a limited amount of standard plugs/sockets rather than the present vast variety of different, partially proprietary, connectors.

Thus a trend is to integrate as many functions as possible into one plug. There are two main drawbacks with this solution. On the one hand the resulting plugs will often not be compatible to standard plugs, i.e. be proprietary because of contacts being relocated compared to the standard arrangement, thus prohibiting a use with standard equipment and different devices. On the other hand a very strict integration, e.g. using only one ground connection for different signals (audio/video), and the fact that contacts/conductors will be located very close to one another, will lead to a decrease in signal quality and electrical problems (interferences, ground loops).

A solution being not satisfying for small electronic devices would be using two different dedicated connectors for audio and video, for example a combination of 3.5 mm stereo plug for audio and a 2.5 mm video plug for the video signals. The drawbacks of such a solution should be obvious.

While the 3.5 mm stereo audio plug has become a quasi standard for pure audio signals there is no comparatively small single plug available for both audio and video signals providing suitable shielding of the video signals; existing connectors like the SCART connector are not suitable for small electronic devices.

U.S. Pat. No. 6,069,960 describes as prior art a 3.5 mm audio plug wherein an additional contact is provided to transfer video signals. This video transmit plug is not compatible to conventional plugs, as the contact for the right stereo channel is displaced and instead the contact usually used for right audio is used for video signals. Further, as such a plug does not provide any shielding means the video signal is exposed to disturbances and video quality will be reduced, also because only a common audio and video ground is used. In this application a kind of active "plug-in" detection based on different impedances is described in order to detect the kind of the plug.

From the aforementioned it is apparent that there is a need for a compact single plug and socket for audio and video signals being small in footprint while also providing for a good electrical signal quality, and preferably being compatible to existing equipment and the standard 3.5 mm audio plug/socket, respectively. Therefore it is an object of the present invention to provide such a plug that is suitable for small portable electronic devices.

SUMMARY

According to a first aspect an audio and video plug is provided. The plug comprises a male audio plug having at least one audio signal plug contact and one audio ground plug contact. The plug is characterized by a substantially cylindrical video ground plug contact located radially outward the audio plug, and being electrically insulated from the audio plug, and at least one video signal plug contact being located inward the video ground plug contact, and being electrically insulated from the video ground plug contact. Such a single plug for both audio and video signals provides a number of advantages. The need for two different plugs is eliminated, providing a more comfortable handling for the user and reducing production costs. Providing the plug with a video signal shielding that is shielding the inside video signal plug contact eliminates or at least substantially reduces disturbances through distortion signals otherwise easily picked up by the video signal line. Moreover having separate ground contacts improves the overall signal quality, as interferences as cross-talk are substantially reduced. Also the plug according to the invention can provide compatibility with existing equipment, i.e. be used also in a standard audio socket without video contacts. As the 3.5 mm audio plug is widely used the plug most preferably has the same form factor.

It is preferred that the video signal plug contact is a pin being located between the video ground plug contact and the audio plug. That is a simple and easy to implement solution, and the pin can have any geometry suitable for the specific application, e.g. circular, slot-like or rectangular.

It is preferred that the video ground plug contact comprises a radially outward extending bulge, and the pin is at least partially located in the bulge. This way the existing space is used most economically, while still providing good shielding and enough space for ensuring proper insulation between contacts. Such a design is also useful if a plug is desired that has to be inserted in a specific orientation.

It is preferred that the video signal plug contact is a substantially cylindrical contact being located between the video ground plug contact and the audio plug. This can provide a symmetrical geometry of the plug, enabling it to be inserted irrespective of its orientation, and be rotated later on, depending on the specific application. Thus user comfort is improved in relation to non-symmetrical plugs.

It is preferred that the video ground plug contact, in a direction parallel to the audio plug and towards the tip end of the audio plug, at least partially projects beyond the video signal plug contact. That way the plug can be designed such that the video ground plug contact makes contact first when inserting it into a corresponding socket. Advantages of such an arrangement will in detail be described in the subsequent description of preferred embodiments.

It is preferred that the video signal plug contact, in a direction parallel to the audio plug and towards the tip end of the audio plug, at least partially projects beyond the video ground plug contact. That way the plug can be designed such that the video signal plug contact makes contact first when inserting it into a corresponding socket. Advantages of such an arrangement will in detail be described in the subsequent description of preferred embodiments.

It is preferred that the audio ground plug contact of the audio plug is separated from the remaining part of the audio ground contact through an electrical insulation to form the video signal plug contact. Such a plug requires only a smaller diameter of the video ground plug contact than with the other embodiments, making the respective plug also smaller in diameter. Also such a video signal plug contact may easily be implemented.

It is preferred that the audio plug comprises a left audio plug contact and a right audio plug contact. As most portable electronic devices provide a left/right channel stereo output this is of course advantageous.

It is preferred that the video ground plug contact or the video signal plug contact are provided with a radial retaining recess in the exposed contact surface. Thus a secure fit of the plug, which is bulkier than conventional plugs without video contacts, in its corresponding socket can be ensured.

It is preferred that the video ground plug contact or the video signal plug contact are provided with a radial retaining protrusion in the exposed contact surface. This will ensure an even slightly better fit in correspondingly equipped sockets, as the retaining area is even bigger.

According to a second aspect of the invention an audio and video socket is provided. The socket comprises a female audio socket having at least one audio signal socket contact and one audio ground socket contact and a video signal socket contact being electrically insulated from the audio socket. The socket is characterized by at least one video ground socket contact located radially outward the audio socket, and being electrically insulated from the audio socket and the video signal socket contact. Such a socket can be used in conjunction with plugs according to the invention, providing the advantages already mentioned.

It is preferred that the video signal socket contact is located radially outward of the audio socket. That way more space for ensuring proper insulation is provided.

It is preferred that the socket comprises at least two video ground socket contacts being electrically insulated from another. That way a plug-in detection can be provided, by detecting when a video ground plug contact of a plug according to the invention shortens the two contacts. This is useful mainly for power saving purposes in portable electronic devices. Conventional plugs will not shorten the contacts and can thus be detected as well.

It is preferred that the socket further comprises a switch adapted to be switched by a plug contacting the video ground socket contact. Such a switch or "video lift-up switch" can provide a plug-in detection. In this manner the respective electronic device can save power by switching on the video output circuit only when an appropriate plug is inserted. Conventional plugs will not actuate the switch. As with other plug-in detection embodiments of the invention the video output can also be enabled after or if the plug is securely inserted into the socket, because otherwise proper shielding can not be ensured.

It is preferred that the video signal socket contact, in a direction parallel to the audio socket, projects further away from the tip end of the audio socket than the video ground socket contact(s). That way the socket can be designed such that the video ground socket contact makes contact first when inserting a corresponding plug. Advantages of such an arrangement will in detail be described in the subsequent description of preferred embodiments.

It is preferred that at least one video ground socket contact, in a direction parallel to the audio socket, projects further away from the tip end of the audio socket than the video signal socket contact. That way the socket can be designed such that the video signal socket contact makes contact first when inserting a corresponding plug. Advantages of such an arrangement will in detail be described in the subsequent description of preferred embodiments.

It is preferred that the audio socket comprises a left audio socket contact and a right audio socket contact. That way a two-channel stereo output can be provided.

It is preferred that the video ground socket contact or the video signal socket contact comprise a radial recess portion adapted to engage a correspondingly shaped protrusion of an inserted plug. Thus a secure fit of the plug, which is bulkier than conventional plugs without video contacts, in the socket can be ensured.

It is preferred that the video ground socket contact or the video signal socket contact comprise a radial protruding portion adapted to engage a correspondingly shaped recess of an inserted plug. This will ensure an even slightly better fit in correspondingly equipped sockets, as the retaining area is even bigger.

According to another aspect of the invention a mobile electronic device is provided. The device comprises an audio video socket as set forth above. The mobile electronic device can be a video-capable mobile phone, a mobile gaming device, PDA or the like.

According to another aspect of the invention an accessory device for a mobile electronic device is provided. The accessory device comprises an audio video plug as set forth above. Such an accessory device can simply be a cable or connection unit to connect the mobile electronic device to a TV set, a PC or other audio/video playback equipment. In order to provide connection capabilities being compatible with standard equipment such a cable unit may, on the side opposite the inventive plug, be provided with any kind of standard audio and video connectors, either one-piece (e.g. SCART) or also split (S-VHS+standard 3.5 or 6.3 mm plug). But the accessory device can also be a device having an integrated or built-in plug—similar like small active speakers for audio players—for example an external LCD display or TV set to be connected with the electronic device to replace the small internal display.

DETAILED DESCRIPTION OF PREFERRED EMBODIMENTS

Common to all embodiments of the invention are two major features. First separate ground contacts are used for video ground and audio ground, respectively. This ensures that both audio and video signals do not interfere with one another via a common ground contact, as they have electrically separated ground lines. Second a suitable shielding of the video signal is achieved through a substantially continuous outer shielding or video ground contact, at least in one of the plug or socket.

Rotationally symmetrical plugs/sockets do not need to be connected in a particular position, and are also not damaged by accidental rotation or torsion. From this point of view they are thus preferred. However also non-symmetrical plugs/sockets can provide certain advantages, particularly if the connection cable is attached on the side of the plug, i.e. also not symmetrical. Unintentional torsion can damage them. Known are substantially L-shaped connectors that usually have a reduced extension parallel to the contact portion, which can be advantageous depending on the geometry of the device they shall be used with. The cable side part of the L-shaped connector can also be received in a corresponding recess provided in the socket, for a stronger fit of the plug. With such L-shaped connectors and the like it may be advantageous to provide a non-symmetrical contact geometry, so the user is pointed to the right orientation in which the plug has to be inserted. In the following description different embodiments and their respective advantages will be discussed in detail. While the following description will refer to a 3.5 mm audio plug/socket it is to be understood that the invention is not limited to this form factor, but may also be employed in plugs/sockets of different sizes.

Figure 1:
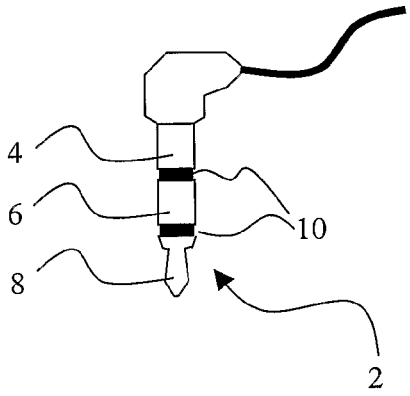
FIG. 1 illustrates the conventional prior art 3.5 mm stereo audio plug.

In FIG. 1 the standard 3.5 mm plug (also known as male connector) is shown. There are also mono variants of 3.5 mm plugs, but they are not widely used anymore, so here is shown only the stereo variant. This standard 3.5 mm stereo audio plug is common to a variety of mp3 players and other audio playback devices. The plug comprises (in the stereo version) 3 contacts, left audio 8, right audio 6 and common audio ground 4, all of which are insulated from one another through insulation portions 10. The tip contact 8 is normally formed as depicted here, to be held inside its socket by a resilient portion in the socket. The standard 3.5 mm stereo plug is widely used in many electronic devices as it is comparatively compact, with good mechanical hold in its socket, and because of its satisfying electrical properties well suited for connecting headsets to electronic devices.

Figure 2:
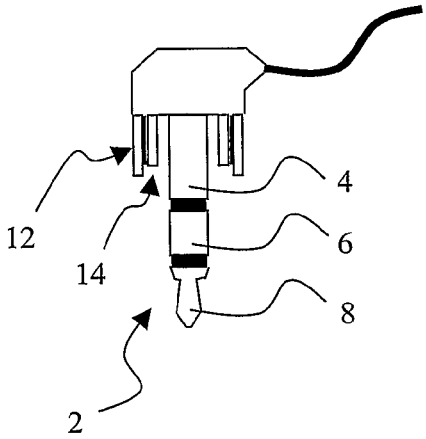
(Prior Art) Fig. 2
FIG. 2 illustrates, in a cross-section view, the audio/video plug according to a first embodiment of the present invention.

FIG. 2 shows in a cross-sectional view the enhanced audio and video plug according to a first embodiment of the present invention. It shall be noted that the connection cable does not need to be attached sideways in the plug as shown here, but can also extend parallel to the plug contact portion or in another fashion. The plug comprises a standard male audio plug 2 like one depicted in FIG. 1. Further it comprises a cylindrical video ground plug contact 12, and a cylindrical video signal plug contact 14. As video signals are likely to be disturbed by electromagnetic interference they have to be shielded. Therefore the plug according to the invention, in this embodiment, comprises the two concentric video plug contacts 12, 14, wherein the video ground plug contact 12 is a cylindrical outer contact shielding the inner video signal plug contact 14 against interference. In this embodiment both video contacts are closed circular cylindrical contacts, but it is to be noted that according to the invention only the outer video ground plug contact 12 is required to be substantially continuous, to achieve good shielding. In fact it is only required for the system of plug and socket to provide a good shielding, so that one of both alone can also have "missing" sections that are compensated by its counterpart when connected with each other. For the same reason, i.e. good shielding, the video signal plug contact 14 has to be located inside this shielding in all embodiments. In this embodiment the video signal plug contact 14 projects beyond the video ground plug contact 12 in a direction towards the tip of the male audio plug 2 and along it. This is to ensure, with a corresponding socket, that the video ground plug contact 12 is connected first when the plug is inserted. This is advantageous not only because the shielding is already complete when the video signal plug contact 14 is connected, but also because in this fashion differences in electric potentials can be discharged before connecting the video signal plug contact 14, to protect the electronic circuit of the respective device from damage. As the video ground plug contact 12 also, through friction, can provide a retaining force holding the plug inside its socket, it can also be advantageous to design the video ground plug contact 12 projecting further. This provides for a bigger contact area resulting in an increased retaining force compared to an embodiment wherein the video signal plug contact 14 was designed projecting further.

Figure 3:
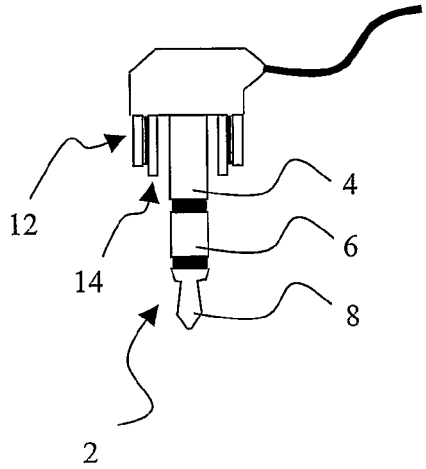
FIG. 3 illustrates, in a cross-section view, the combined audio/video plug according to a variation of the first embodiment of the present invention.

FIG. 3 shows a variant of the embodiment of FIG. 2, differing in that the video signal plug contact 14 projects further towards the tip than the video ground plug contact 12. This can be advantageous, in connection with a correspondingly equipped socket, to provide for a "plug-in detection", e.g. two contacts can be shorted by the (shorter) video ground plug contact 12 only after the (longer) video signal plug contact 14 is already connected, to enable the respective electronic device to recognize that an audio/video output cable has been connected. As with battery powered portable devices power saving measures are of great importance this enables to switch on the video output circuit only in case it is actually needed. As with all other embodiments of the plug according to the invention the geometry can be designed such that the plug according to the invention can be used as a standard 3.5 mm stereo socket as well. Therefore the additional video contacts have to be arranged such that they do not prevent the plug from being properly received when inserting the plug into a standard 3.5 mm stereo socket.

Figure 4A:
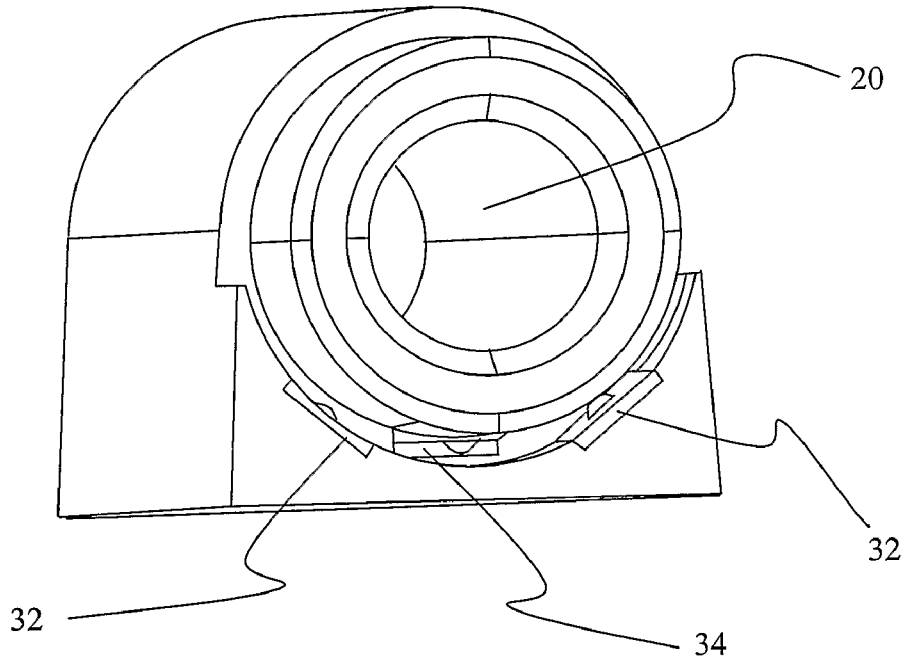
FIGS. 4*a* and 4*b* illustrate an embodiment of the socket of the invention in a 3D view (4*a*) and a plan view (4*b*)

FIG. 4*a* shows a 3D view of a socket (also known as female connector) according to an embodiment of the invention, and corresponding to the plugs of FIGS. 2 and 3. In the centre a standard 3.5 mm socket 20 is located, wherein also standard 3.5 mm plugs can be inserted instead of a plug with video connections according to the invention. Radially outward the socket a circular recess is formed, in the embodiment depicted here only extending over a section of the whole circle. On the inner side of this recess one video signal socket contact 34 is located, but in order to improve the contact with a corresponding plug also more than one contact can be provided, or the contact can extend over a longer portion. Two video ground socket contacts 32 are located on the outer side of the recess. While at least one video ground socket contact 32 is required using more than one provides for a better contact with a plug, and as another advantage a "plug in detection" can be performed with two contacts. If a plug is inserted into the socket its outer video ground plug contact will shorten the two video ground socket contacts 32 thus enabling a device to detect that a video connection has been established. As the socket according to the invention is particularly intended for portable electronic devices this provides the possibility for improved power saving, i.e. to switch on the video output circuit only in case it is actually needed. All the contacts can be located in the same plane perpendicular to the longitudinal extension of the 3.5 mm socket. In other embodiments it can be advantageous to locate contacts in different spaced planes, so that the contacts are not contacted simultaneously when inserting a plug. For example it can thus be achieved to first connect the video ground contacts and only then the video signal contacts, so that a video signal is only outputted when proper shielding through the video ground contacts has been established. In this manner the electronic of the device can also be protected from static discharges or differences in electrical potential.

Figure 4B:
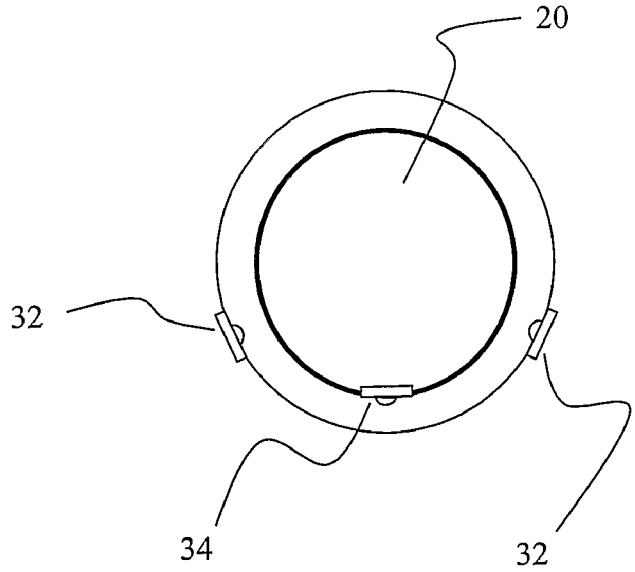

In FIG. 4*b* a plan view of the socket of FIG. 4*a* is shown.

Figure 5:
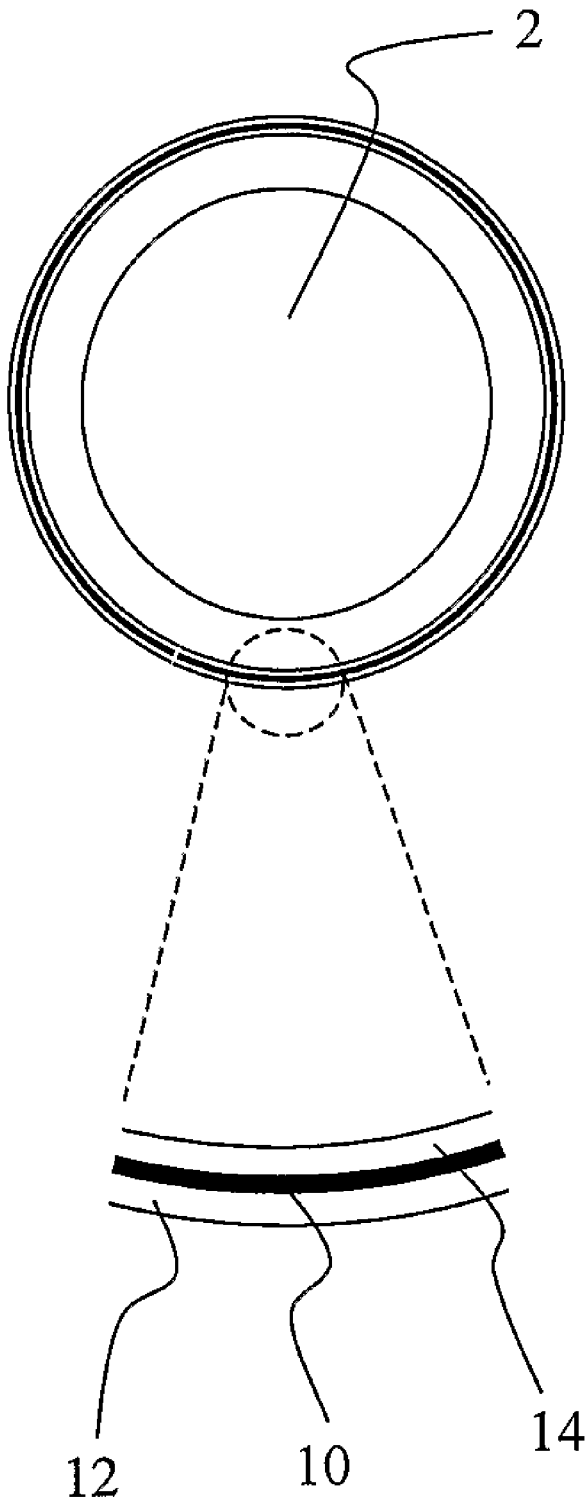
FIG. 5 illustrates a plug according to the invention corresponding to the socket of FIGS. 4*a* and 4*b*, and according to FIGS. 2 and 3, in a plan view with a partially enlarged portion.

FIG. 5 shows the plug according to an embodiment of the invention, and corresponding to the socket of FIGS. 4*a* and 4*b*. This plug also corresponds to the embodiments of FIGS. 2 and 3, and is shown in a plan view here. In this embodiment the plug is constituted by a standard 3.5 mm plug 2 in its centre, and two circular cylindrical plug contacts 14, 12, both located radially outward the plug 2. An insulation 10 separates the inner video signal plug contact 14 from the outer video ground plug contact 12, as emphasized in the figure. In this plan view it is not shown which of the two video plug contacts is projecting further out of the drawing plane; the two possibilities according to the invention are illustrated in FIGS. 2 and 3.

Figure 6A:
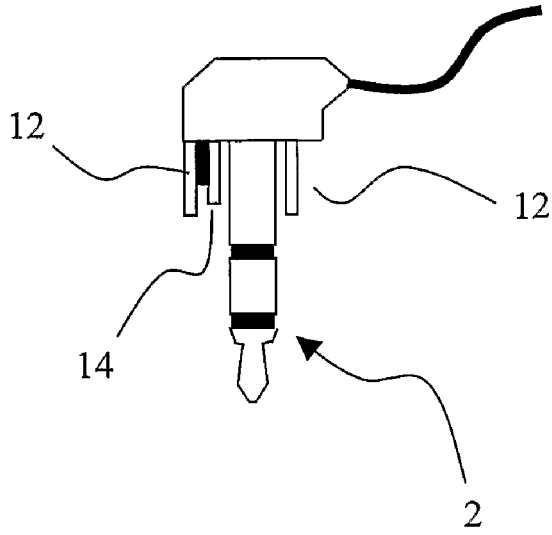
FIGS. 6*a* and 6*b* illustrate a second embodiment of the audio/video plug according to the invention, in a longitudinal sectional view (6*a*) and a plan view (6*b*)
Figure 6B:
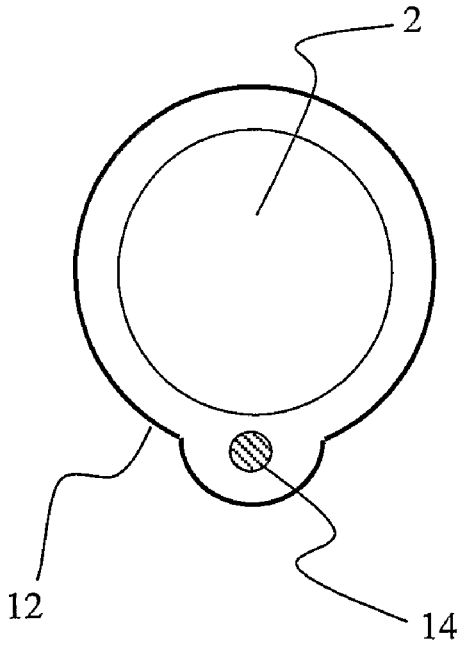

FIGS. 6*a* and 6*b* show an alternative embodiment of the video/audio plug of the invention. In 6*a* the plug is shown in a longitudinal sectional view. Similar to the other embodiments a standard 3.5 mm plug 2 and an outer video ground plug contact 12 for shielding the video signal are provided. An inner video signal plug contact 14 in form of a pin is provided between the plug and the outer shielding 12. The pin can be substantially circular or rectangular (not shown), and also other shapes can be advantageous. As can be seen from FIG. 6*b* this pin 14 is, in this embodiment, located inside an outwardly extending bulge of the video ground plug contact 12. While the invention is not limited to this specific geometry of the contacts this is preferable, because in this way the pin 14 can be located inside the shielding while not requiring to arrange the video ground plug contact 12 far outward in the radial direction to provide for enough space for a suitable insulation (not shown) between the pin 14 and the video ground plug contact 12. To provide a circular cylindrical video ground plug contact 12 with a suitable diameter to achieve this latter would waste a lot of space making the plug rather bulky. Also, to provide the bulge on the video ground plug contact 12 enables a user to easily recognize in which orientation the plug is to be inserted. While a contact geometry as illustrated here prevents the plug from being inserted in every possible orientation and also from being rotated afterwards it can though be advantageous for L-shaped plugs for example. In the electronic device with the corresponding socket a recess could be provided for receiving the outer (cable side) part of the L-shaped plug, thus providing for a better electrical contact undisturbed by rotating the plug, and also can provide a better fit in the socket preventing accidental removal of the plug. As such a plug would then appear like being integrated into the device this also provides design advantages, because no protruding parts exist.

Figure 7:
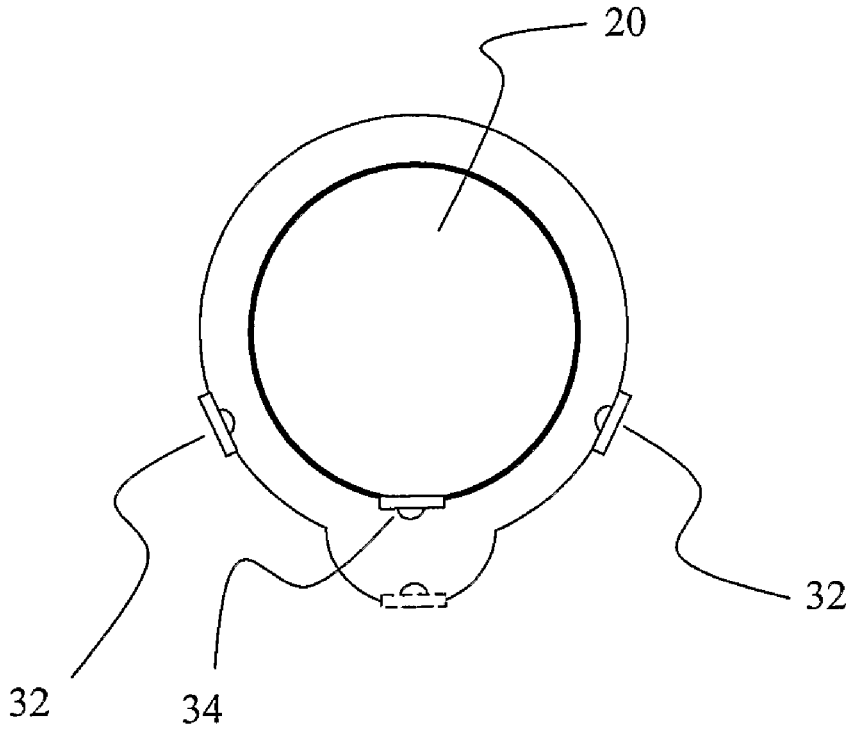
FIG. 7 illustrates a socket according to the invention corresponding to the plug of FIGS. 6*a* and 6*b* in a plan view.

FIG. 7 illustrates the socket according to the invention corresponding to the plug of FIGS. 6*a* and 6*b* in a plan view. Similar to the previous embodiments of the socket one video signal socket contact 34 and two video ground socket contacts 32 are provided on the inner and the outer side of a recess, respectively. A bulge is formed in the recess for receiving the pin section of a corresponding plug. It has to be noted that the video signal socket contact 34 can be located anywhere surrounding the bulge, as long as it can contact the corresponding plug pin, in this embodiment it is not required to be located on the inner side of the recess. An alternative location of the video signal or pin socket contact 34 is shown with a dashed line. The flexibility in locating the pin socket contact 34 can help to design a socket that is more compact than the other embodiments, though not completely symmetrical and thus not enabling a plug to be rotated.

Figure 8A:
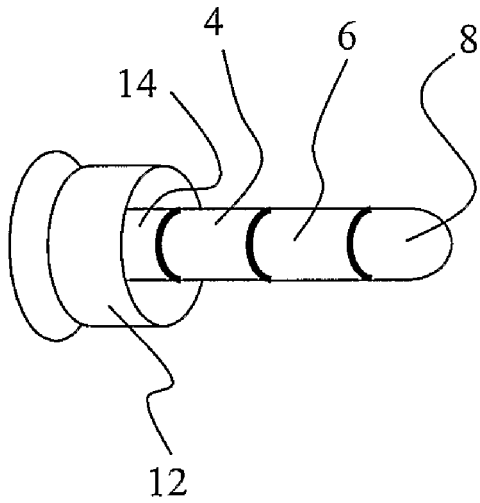
FIG. 8*a* shows a third embodiment of the plug according to the invention.

FIG. 8*a* shows another alternative embodiment of a plug according to the invention. Similar to the other embodiments it comprises a standard 3.5 mm plug with left audio plug contact 8, right audio plug contact 6 and audio ground plug contact 4, and an outer video ground plug contact 12. In this variant the video signal plug contact 14 is embodied as part of the audio ground plug contact 4 of the 3.5 mm plug, i.e. part of the audio ground plug contact of a conventional plug is insulated and used for this purpose, preferably on the side of the audio ground plug contact 24 opposite the plug tip, to maintain compatibility. As in this embodiment the outer video ground plug contact 12 can be designed with the smallest diameter compared with the other embodiments, this plug can be made very small in diameter as well.

Figure 8B:
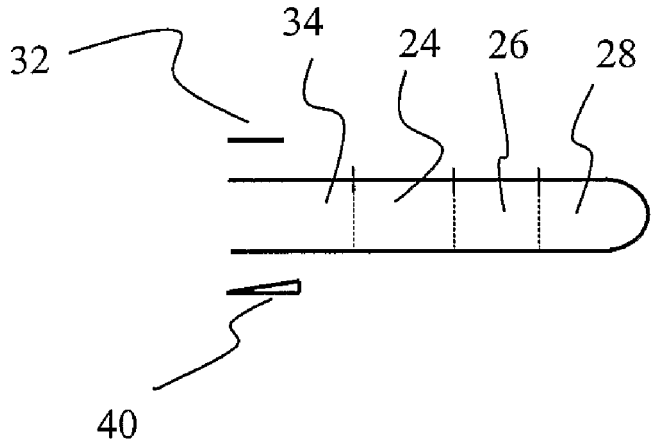
FIG. 8*b* shows the socket according to the invention corresponding to the plug of FIG. 8*a;*

FIG. 8*b* shows, in a longitudinal sectional view, a socket corresponding to the plug of FIG. 8*a*, with corresponding left audio socket contact 28, right audio socket contact 26, audio ground socket contact 24 and video signal socket contact 34. Here another detail is illustrated that may also be applied to other embodiments of this invention. A switch 40 is provided that will be actuated by the video ground plug contact 12 of the plug according to FIG. 8*a* if the corresponding plug is inserted. The switch 40 can be used as video "plug in" detection and provides the same advantages as already mentioned before, and it also serves as a contact for the video ground plug contact 12 of the plug. A "plug in" detection for standard plugs can be implemented on the tip side of this socket, in a known manner, e.g. by another switch contact. Similarly to other embodiments of the invention a standard 3.5 mm plug can be inserted in the socket, which provides for compatibility to existing equipment, but as it will not actuate the switch 40 the electronic device can detect that no video out connection is made and keep the video output circuit powered down for power saving purposes.

Figure 9A:
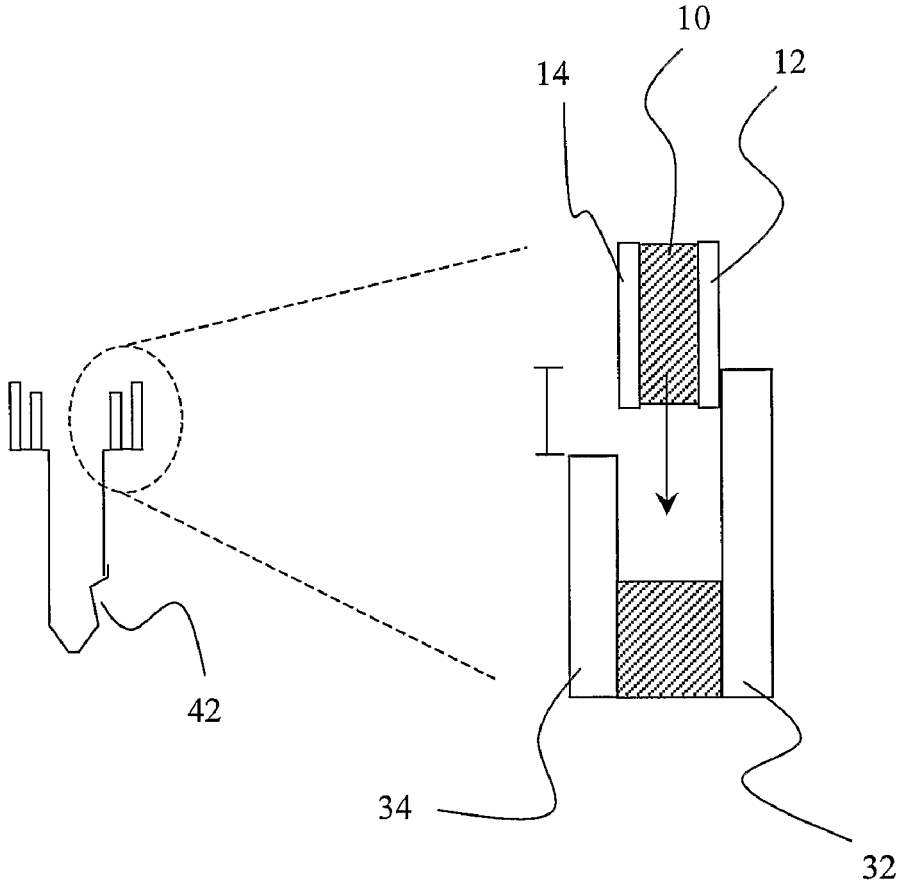
FIGS. 9*a* and 9*b* show in partially enlarged views the contact situation with embodiments of the invention.

FIG. 9*a* shows in detail an embodiment of the socket according to the invention. A standard 3.5 mm socket is provided, according to the invention, with additional video contacts, one video signal socket contact 14 and one video ground socket contact 12. A resilient element 42 is also included with the socket, to prevent an inserted plug from accidental removal. Providing such an element is part of the state of the art and shall thus not be discussed in detail. The two video contacts are shown in an enlarged view on the right side of the figure. As the video ground socket contact 12 projects further up than the video signal socket contact 14 the plug shown here will first contact the video ground socket contact 12. The advantages of such a configuration have previously been discussed. Depending on the specific embodiment it may also be advantageous to reverse this configuration, to make the video signal socket contact 14 become connected first.

Figure 9B:
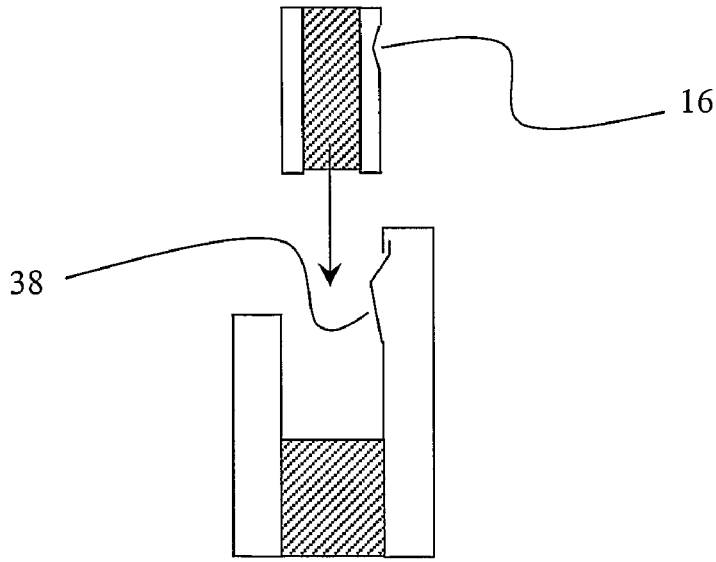

FIG. 9*b* shows another detail that is applicable to all other embodiments of the invention as well, here in connection with the embodiment of FIG. 9*a*. As the plugs according to the invention all have in common that they are wider and thus more bulky and heavier than conventional stereo audio plugs the conventional provisions against unintended removal of a plug may not be sufficient. One possible solution would be to provide a stronger resilient element 42 engaging the plug. However this might not be sufficient to ensure proper fit, as the contact area in the tip section is comparatively small. So another solution could be to provide either the video signal plug contact 14 of the plug, or preferredly the video ground plug contact 12, with a recess 16 engaging an additional protruding resilient element 18 that is correspondingly provided in the socket, or vice versa. In this figure the variant with a recess 16 in the video ground plug contact 12 is illustrated. As the video ground plug contact 12 is the element being located the farthest out in the radial direction this will provide a high level of stability to the system of plug/socket against unintended removal of an inserted plug, and can also help to improve the electrical contact. The recess 16 and the corresponding resilient element 38 can be provided over the whole extension of the respective contact, especially in cases with rotatable contacts, but may also be provided only in one section or a plurality of sections thereof, especially in cases with non-rotatable contacts.

Figure 10A:
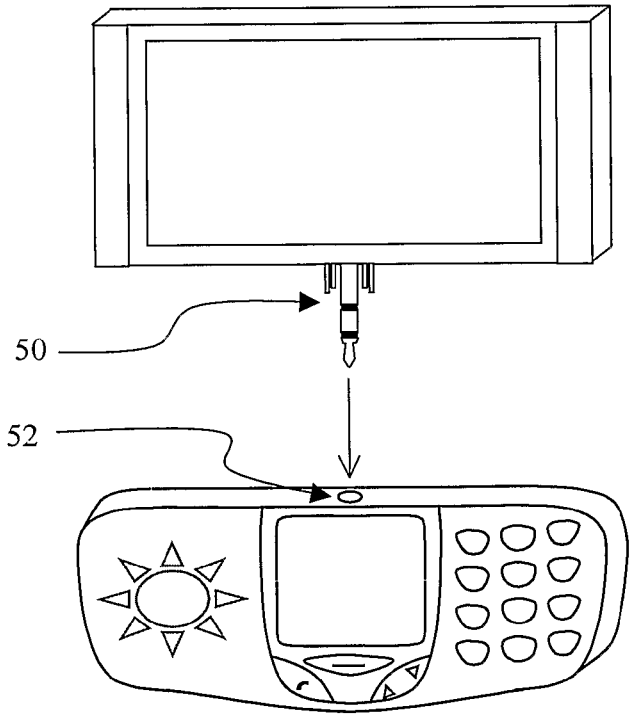
FIGS. 10*a* and 10*b* show two example applications of the present invention.

FIG. 10 shows two exemplary applications of the invention. In FIG. 10*a* an accessory device, comprising a plug 50 according to the invention, in form of an external LCD display for a mobile gaming device is illustrated, together with a mobile gaming device comprising a corresponding socket 52. The display can be plugged into the gaming device to replace the small internal display. Of course a plurality of other devices with audio/video capabilities is conceivable, for example TV sets with built-in plug, so this figure shows but one possible application.

Figure 10B:
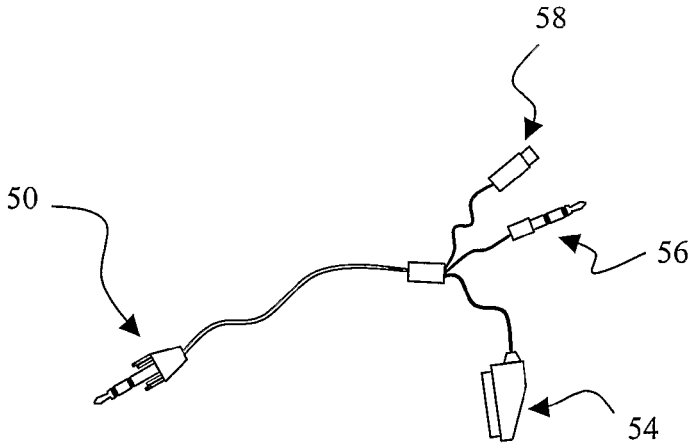

FIG. 10*b* shows another, simple embodiment wherein the plug 50 according to the present invention can be employed. This embodiment stands exemplary for a variety of possible connection units that are enabled by the present invention, for connecting a gaming device or similar (comprising a corresponding socket 52) to a TV set or other audio/video equipment, i.e. without having audio/video processing capabilities itself. Additionally to the plug according to the invention all common connectors can be utilized for this purpose, like SCART 54, S-VHS 58, and 3.5 mm stereo 56 for example.

The invention is particularly useful in conjunction with portable electronic devices like cellphones, PDAs, game decks and the like, but of course the connection system according to the invention can be employed for connecting all kinds of multimedia applications, either portable or stationary. Only one combined connector provides for a user friendly easy handling, a reduction of occupied space, a cost reduction in the production, and it shows superior electrical signal quality and EMC performance.

The invention claimed is:

1. An audio and video plug comprising:

an audio plug including an audio signal plug contact and an audio ground plug-contact;

a substantially cylindrical video ground plug contact located radially outward from said audio plug, wherein said video ground plug contact is electrically insulated from said audio plug; and a video signal plug contact located radially inward of said video ground plug contact, wherein said video signal plug contact is electrically insulated from said video ground plug contact.

2. The audio and video plug of claim 1, wherein said video signal plug contact is a pin located between said video ground plug contact and said audio plug.

3. The audio and video plug of claim 2, wherein said pin is at least partially located within a radially outward extending bulge of said substantially cylindrical video ground plug contact.

4. The audio and video plug of claim 1, wherein said video signal plug contact is a substantially cylindrical contact located between said video ground plug contact and said audio plug.

5. The audio and video plug of claim 1, wherein at least a portion of said video ground plug contact projects beyond said video signal plug contact in a direction toward a tip end of the audio plug.

6. The audio and video plug of claim 1, wherein at least a portion of said video signal plug contact projects beyond said video ground plug contact in a direction toward a tip end of the audio plug.

7. The audio and video plug of claim 1, wherein a first portion of said audio ground plug contact is electrically insulated from a second portion of said audio ground plug contact, and wherein said first portion of said audio ground plug contact comprises the video signal plug contact.

8. The audio and video plug of claim 1, wherein said audio plug comprises a left audio plug contact and a right audio plug contact.

9. The audio and video plug of claim 1, wherein said video ground plug contact or said video signal plug contact comprise a radial retaining recess in a contact surface.

10. The audio and video plug of claim 1, wherein said video ground plug contact or said video signal plug contact are provided with a radial retaining protrusion in the contact surface.

11. An audio and video socket comprising:

an audio socket including an audio signal socket contact and an audio ground socket contact;

a video ground socket contact located radially outward from said audio socket, wherein said video ground socket contact is electrically insulated from said audio socket; and a video signal socket contact electrically insulated from said audio socket and said video ground socket contact, wherein said video signal socket contact is located radially inward from said video ground socket contact.

12. The audio and video socket of claim 11, wherein said video signal socket contact is located radially outward from said audio socket.

13. The audio and video socket of claim 11, comprising at least two video ground socket contacts electrically insulated from each other.

14. The audio and video socket of claim 11, further comprising a switch adapted to be actuated by contact with a video ground plug contact of a plug.

15. The audio and video socket of claim 11, wherein at least a portion of said video signal socket contact extends further away from a tip end of said audio socket than said video ground socket contact.

16. The audio and video socket of claim 11, wherein at least a portion of said video ground socket contact extends further away from a tip end of said audio socket than said video signal socket contact.

17. The audio and video socket of claim 11, wherein said audio socket comprises a left audio socket contact and a right audio socket contact.

18. The audio and video socket of claim 11, wherein said video ground socket contact or said video signal socket contact comprises a radial recessed portion adapted to engage a correspondingly shaped protrusion of an inserted plug.

19. The audio and video socket of claim 11, wherein said video ground socket contact or said video signal socket contact comprises a radial protruding portion adapted to engage a correspondingly shaped recess of an inserted plug.

20. A mobile electronic device comprising:

an audio and video socket comprising:

an audio socket including an audio signal socket contact and an audio ground socket contact;

a video ground socket contact located radially outward from said audio socket, wherein said video ground socket contact is electrically insulated from said audio socket; and a video signal socket contact electrically insulated from said audio socket and said video ground socket contact, wherein said video signal socket contact is located radially inward from said video ground socket contact.

21. The audio and video socket of claim 11, wherein said video ground socket contact and said video signal socket contact are located in different planes perpendicular to a longitudinal axis running through said audio and video socket.

22. An accessory device, adapted to be connected to an electronic device, the accessory device comprising:

an audio and video plug comprising:

an audio plug including an audio signal plug contact and an audio ground plug contact;

a substantially cylindrical video ground plug contact located radially outward from said audio plug, wherein said video ground plug contact is electrically insulated from said audio plug; and a video signal plug contact located radially inward of said video ground plug contact, wherein said video signal plug contact is electrically insulated from said video ground plug contact.

23. The accessory device of claim 22, wherein said video signal plug contact is a pin located between said video ground plug contact and said audio plug.

* * * * *